US005165887A

United States Patent [19]

Ahmady

[11] Patent Number: 5,165,887

[45] Date of Patent: Nov. 24, 1992

[54] BURNER ELEMENT OF WOVEN CERAMIC FIBER, AND INFRARED HEATER FOR FLUID IMMERSION APPARATUS INCLUDING THE SAME

[75] Inventor: Farshid Ahmady, Rochester Hills, Mich.

[73] Assignee: Solaronics, Rochester, Mich.

[21] Appl. No.: 763,573

[22] Filed: Sep. 23, 1991

[51] Int. Cl.[5] ..... F23D 14/14

[52] U.S. Cl. ..... 431/329; 431/326; 126/92 AC

[58] Field of Search ..... 431/328, 326, 329; 126/92 AC, 92 C

[56] References Cited

U.S. PATENT DOCUMENTS

| | | | |
|---|---|---|---|
| 444,850 | 1/1891 | Reed . | |
| 3,087,484 | 4/1963 | Eddy . | |
| 3,179,156 | 4/1965 | Weiss et al. . | |
| 3,191,659 | 6/1965 | Weiss . | |
| 3,199,573 | 8/1965 | Flynn . | |
| 3,269,449 | 8/1966 | Witten . | |
| 3,275,497 | 9/1966 | Weiss et al. . | |
| 3,383,159 | 5/1968 | Smith et al. . | |
| 3,485,230 | 12/1969 | Harrington et al. . | |
| 3,726,633 | 4/1973 | Vasilakis et al. . | |
| 3,804,163 | 4/1974 | Bradley et al. . | |
| 3,833,338 | 9/1974 | Badrock . | |
| 3,857,669 | 12/1974 | Smith et al. . | |
| 3,857,670 | 12/1974 | Karlovetz et al. | 431/329 |
| 4,189,297 | 2/1980 | Bratko et al. . | |
| 4,255,123 | 3/1981 | Bishilany, III et al. . | |
| 4,301,772 | 11/1981 | Eising . | |
| 4,397,299 | 8/1983 | Taylor et al. . | |
| 4,480,988 | 11/1984 | Okabayashi et al. | 431/329 |
| 4,599,066 | 7/1986 | Granberg | 431/329 |
| 4,651,714 | 3/1987 | Granberg . | |
| 4,685,425 | 4/1987 | Eising . | |
| 4,721,456 | 1/1988 | Granberg et al. . | |
| 4,742,800 | 5/1988 | Eising . | |
| 4,746,287 | 5/1988 | Lunnutti . | |
| 4,790,268 | 12/1988 | Eising . | |
| 4,809,672 | 3/1989 | Kendall et al. . | |
| 4,875,465 | 10/1989 | Kramer . | |
| 4,878,837 | 11/1989 | Otto | 431/329 X |
| 4,883,423 | 11/1989 | Holowczenko . | |
| 4,898,151 | 2/1990 | Luebke et al. . | |
| 4,919,609 | 4/1990 | Sarkisian et al. . | |
| 5,022,352 | 6/1991 | Osborne et al. | 431/329 X |

FOREIGN PATENT DOCUMENTS

| | | |
|---|---|---|
| 703246 | 2/1965 | Canada . |
| 1486796 | 6/1967 | France . |
| 57-155012 | 9/1982 | Japan . |
| 61-070313 | 4/1986 | Japan . |
| 61-143613 | 7/1986 | Japan . |
| 7808335 | 8/1978 | Netherlands . |

*Primary Examiner*—Larry Jones
*Attorney, Agent, or Firm*—Lynn E. Cargill

[57] ABSTRACT

An infrared heater for a fluid immersion apparatus such as a commercial deep fat fryer includes a burner whose burner element is made from woven ceramic fibers, preferably formed as a cloth. The burner can also include a wire mesh or screen for supporting the cloth; alternatively, the cloth can be made self-supporting through the wrapping or affixing of several cloth layers together. The burner element possesses a predetermined gas permeability adequate to avoid any significant backflash during the use of the burner. The gas permeability is selected to match the flow rate, composition and backpressure of the selected gas, and takes into account the insulative capacity of the fiber weave employed. The resulting burner construction is substantially more durable and resistant to damage during replacement or inspection than are burners having conventional ceramic elements, such as foams, felts, or the like.

33 Claims, 3 Drawing Sheets

FIG 2
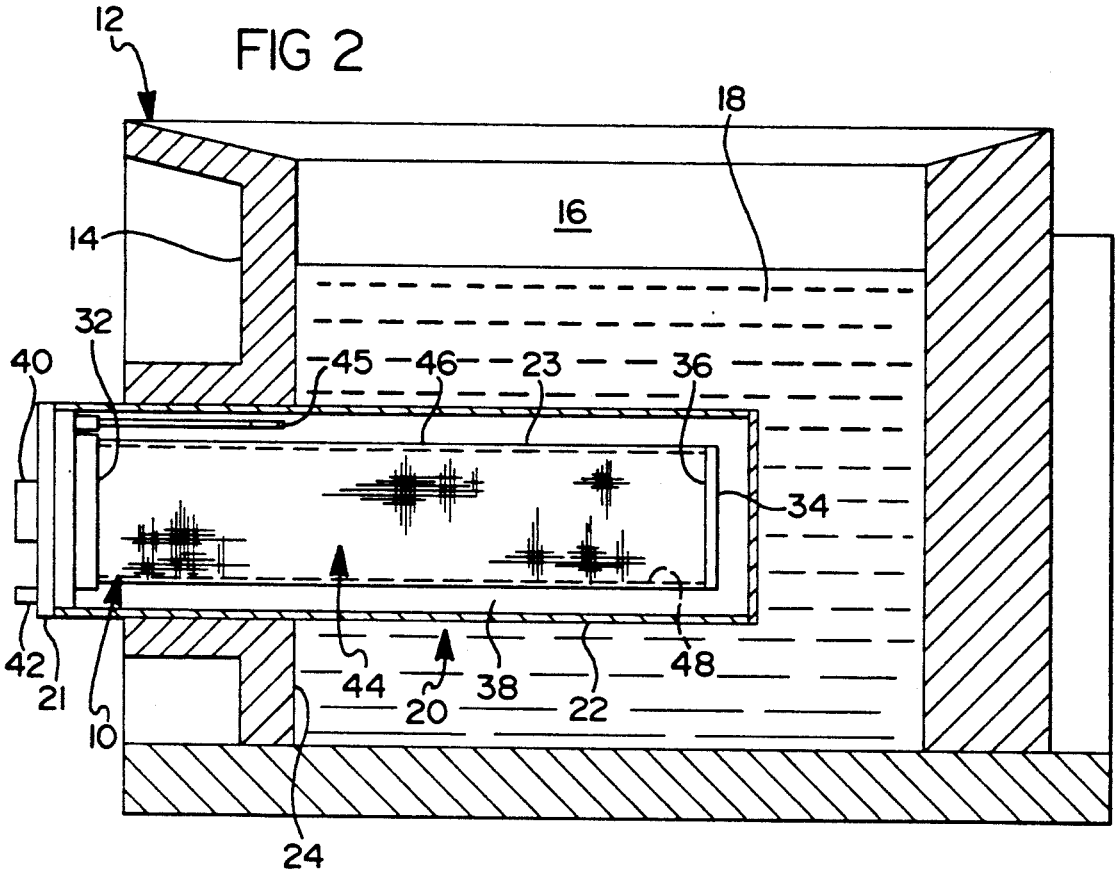
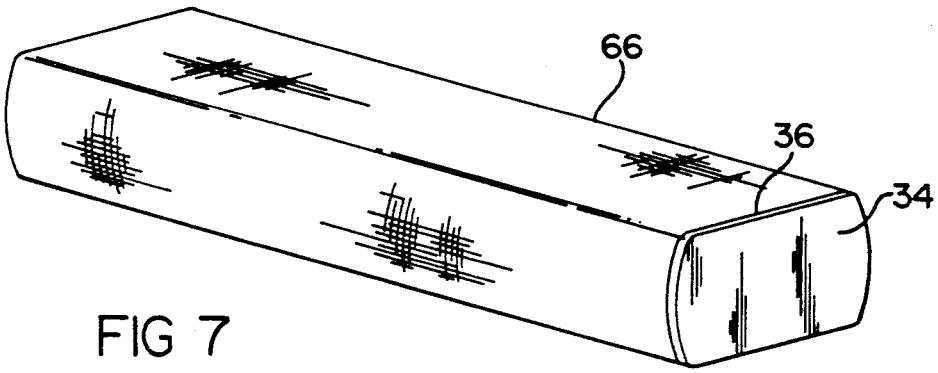
FIG 7

BURNER ELEMENT OF WOVEN CERAMIC FIBER, AND INFRARED HEATER FOR FLUID IMMERSION APPARATUS INCLUDING THE SAME

TECHNICAL FIELD

This invention relates generally to gas burners, and more particularly gas burners having burner elements made of woven ceramic fibers.

BACKGROUND OF THE INVENTION

Gas burners having radiant burner elements have long been used to heat fluids in commercial, industrial and residential applications. Such applications include areas as diverse as home heating and commercial deep fat fry cookers. In one known form of gas burner, a combustible gas or air-gas mixture is passed through a burner element including one or more flat plenum clay tiles. The gas is burned on the surface of the element. Such burners have sometimes been found to be undesirable for many purposes, because they are inefficient as they often loose heat to the environment and undesirably heat incorrect sections of the apparatus in which they are employed. U.S. Pat. No. 4,919,609 (Sarkisian et al., Apr. 24, 1990) and U.S. Pat. No. 4,397,299 (Taylor et al., Aug. 9, 1983) disclose two examples of gas burners employing gas-permeable tiles.

It has also been found that, under some circumstances, gas burners more efficiently consume the fuel gas when their burner elements are configured as cylinders. While various methods have been employed to construct cylindrical burner elements, their use has been found to require a careful balance of pressurized gases to ensure that the supplied pressure is uniform, so that the flame on the surface of the burner element does not creep back into the burner, particularly into any mixing chamber contained within the burner element, and explode or backflash.

The following criteria are believed to be important in selecting the material to be used for distributing gas in a gas burner element:

1. The material needs to permit a low pressure drop across the burner element.

2. The material must have uniform openings for evenly distributing the gas mixture at the surface of the burner element.

3. The material must have good insulative properties in order to prevent backflashing.

4. The material must support ignition and combustion only on its downstream surface, typically its outer surface. This criterion is particularly important when the combustion gas is propane. Propane gas has a higher flame velocity than natural gas (about 2.85 feet per second to about 1 foot per second), so that its flame has a higher tendency to creep into the pores of a burner element.

Some prior attempts to meet these criteria have involved the use in burner elements of ceramic fibers in various configurations, such as in felts, sintered webs, random orientations and ceramic fiber filters. Such attempts often encountered drawbacks such as non-uniform pore sizes, high backpressures, and backflashing when flames crept back into the mixing chamber or other source of the combustion gas. The last-mentioned type of ceramic fiber burner element, the filter, is conventionally made by placing short, wetted ceramic fibers, and (optionally) a binder, over a screen of a particular mesh size, and vacuuming out the moisture to form a cylinder of fibers. Such a construction is subject to several of its own particular drawbacks. Such fibrous elements lack integrity. Moreover, because the fiber matrix must be thin enough to allow gas to pass through it, the strength of the matrix is compromised and the material degrades during use. Furthermore, with both filter-like constructions and constructions such as felts, the burner elements easily clog with dust and other impurities carried by the air and combustion gas, so that the filters require increased pressures to insure an adequate flow of combustion gas through the elements in which they are employed.

Felt-type ceramic fiber burner elements are shown in U.S. Pat. No. 4,604,054 (Smith, Aug. 5, 1986), U.S. Pat. No. 3,425,675 (Twine, Feb. 4, 1969), U.S. Pat. No. 3,208,247 (Weil et al., Sep. 28, 1965) and U.S. Pat. No. 3,191,659 (Weiss, Jun. 29, 1965). Burner elements constructed from vacuum-drawn ceramic fibers are disclosed in U.S. Pat. No. 4,883,423 (Holowczenko, Nov. 28, 1989), U.S. Pat. No. 4,809,672 (Kendall et al., Mar. 7, 1989), U.S. Pat. No. 4,746,287 (Lannutti, May 24, 1988), U.S. Pat. No. 3,275,497 (Weiss et al., Sep. 27, 1966), and U.S. Pat. No. 3,179,156 (Weiss et al., Apr. 20, 1965). A burner element incorporating sintered reticulated ceramic webs is shown in U.S. Pat. No. 4,568,595 (Morris, Feb. 4, 1986), while U.S. Pat. No. 4,519,770 (Kesselring et al., May 28, 1985) and U.S. Pat. No. 4,416,618 (Smith, Nov. 22, 1983) disclose burner elements including ceramic fibers in random orientations. Other burner element constructions are shown in U.S. Pat. No. 4,898,151 (Luebke et al., Feb. 6, 1990) and U.S. Pat. No. 3,726,633 (Vasilakis et al., Apr. 10, 1973), as well as in Japanese published applications JP 61-143613 (NGK Insulators Ltd., published Dec. 18, 1984) and JP 61-070313 (NGK Insulators KK, published Apr. 11, 1986), and in French Patent No. FR 1,486,796 (Sangotoki Kabushiki Kaisha, Jun. 30, 1967).

One recent attempt at obviating the problems encountered with these or similar burner elements has been to construct burner elements from ceramic foams. Ceramic foams are made by soaking a polyurethane foam or other combustible foam material with a liquid ceramic material, drying off the mixture, and burning off the foam material, leaving a porous ceramic structure. The number of pores per inch in the resulting burner element can be selected by choosing the proper pore size of the precursor foam.

While ceramic foam materials were first developed for filtering high temperature casting alloys, the use of such ceramic foams as burner elements is described in the present Applicant's prior U.S. Pat. No. 4,900,245 (issued Feb. 13, 1990). Applicant's device as disclosed in that patent has found significant utility in devices such as commercial deep fat fryers. The burner element is made from a reticulated ceramic foam having a porosity of about 40 to about 100 pores per linear inch, formed about a perforate cylindrical metal diffuser. A high emissivity coating is placed on the reticulated ceramic foam burner element for substantially decreasing the likelihood of backflashing.

Applicant's prior burner element functions admirably for its intended purpose. However, its use in practice has been found to be subject to some drawbacks. Like other ceramic foam elements, some shrinkage and brittleness has been encountered. When the burner elements need to be replaced due to routine maintenance, moving, or unrelated repair of the fryers in which they are employed, the elements sometimes break because of this brittleness. Moreover, control of the pore size is perhaps not as precise as would be desired in order to insure that enough air is supplied to the combustion gas and avoid backflashing. Even when these problems are not encountered, the ceramic foam eventually melts down and becomes more brittle when the supply of air decreases, as it periodically may do. As a practical matter, once the ceramic foam elements are removed a single time from the device in which they are employed, they are often not subject to ready reuse.

Accordingly, it is an object of the present invention to provide a highly efficient radiant heat burner element for a fluid immersion apparatus or other device, which will uniformly burn combustion gases without backflashing.

It is another object of the present invention to provide a radiant heat burner element of lower shrinkage and lower brittleness than encountered with prior ceramic burner elements.

It is a further object of the present invention to provide a ceramic burner element which is readily subject to reuse and which does not easily break during replacement.

It is also yet another object of the present invention to provide a radiant heat burner element which is more reliable and less subject to clogging than have been past ceramic burners.

SUMMARY OF THE INVENTION

In accordance with the preferred embodiment of the invention, these and other objects and advantages are addressed as follows.

The present invention solves the problems of control of pore size and breakage of brittle ceramic burner elements by providing a gas burner comprising a hollow burner element made from woven ceramic fibers. The weave of the element is selected to have a predetermined gas permeability which matches the flow rate, composition and backpressure of the combustible gas being burned, so as to allow burning of the combustible gas on a surface of the burner element, without significant backflashing. The ceramic fibers are preferably formed as a cloth of fibers of materials such as a metal oxide, alumina, quart, or vitreous silica, most preferably of alumina-boria-silica. The cloth is preferably about 0.1 to 4.0 millimeters thick and is characterized by a pore size of 0.01 to 0.06 inches, so as to have a gas permeability of about 25 to 500 cubic feet per square foot per minute.

In a first preferred embodiment, the woven fibers of the burner element are supported by a metallic layer support, such as a coil spring or a wire mesh cylinder, about which the cloth is wrapped. The open end of the coil spring or mesh cylinder is closed by a ceramic cap sealed to the cylinder or coil spring by a liquid ceramic. When the ceramic fibers are configured as a sheet of cloth, the abutting ends of the cloth are together by ceramic fiber threads, preferably of the same composition as the cloth itself, to form a seam.

In another preferred embodiment of the present invention, the woven ceramic fiber is formed into a self-supporting element, for example, as a plurality of cloth layers joined together by ceramic fiber threads, so as to prevent movement of the layers relative to one another. Preferably, the ceramic fiber threads are composed of the same ceramic fiber as the cloth itself. While a plurality of individual, discrete ceramic fiber layers can be employed in this fashion, most conveniently the burner element can be formed as a spiral wrap of a single piece of cloth, forming plural layers. The open end of the element is again closed by a ceramic cap and sealed to the woven fiber with a liquid ceramic, or can be pinched closed by tacking with ceramic fiber or other heat-resistant threads.

A variety of burner element shapes are contemplated within the invention, including cylindrical, tubular, and relatively flattened shapes.

The present invention also encompasses a gas burner including a burner element of the type disclosed, as well as an ignition element positioned adjacent a surface of the burner element through which the combustible gas passes, and means adapted to supply combustible gas and air to the burner element.

The invention is also directed to an infrared heater fueled by a flowing combustible gas, which comprises the burner and ceramic fiber element described above, the disclosed ignition element and gas and air supply means, and a metal tube disposed about and spaced from the burner element, so as to define a plenum (between the burner element and the tube) to which either air or combustion gas is supplied.

In yet another embodiment, the invention comprises a fluid immersion apparatus such as a deep fat fryer in which the metal tube of the heater forms part of the fluid tank of the apparatus, preferably part of one of the walls of the fluid tank.

The present invention enjoys significant advantages due to its use of a woven ceramic fiber burner element. The use of such a burner element provides a significant cost saving throughout the lifetime of the apparatus in which the burner and burner element are used. One way in which cost should be saved is in an anticipated reduction in the need for periodic maintenance of the burner; since the woven ceramic fiber burner element has a pore size greater than the pore size of prior ceramic felts or vacuum-drawn fiber elements, less clogging of the burner element from contaminants in the combustible gas will be encountered. A second way in which cost is saved lies in the flexibility of the ceramic woven fibers making up the burner element with respect to one another, so that the brittleness encountered in prior ceramic foam burner elements is avoided. The woven ceramic fiber burner elements can be withdrawn from a fluid apparatus such as a commercial deep fat fryer without damage; even if the burner element is knocked against a hard object, the worst that should usually happen is that the element or its supporting wire coil or mesh needs to be pushed back into its original shape. The impact, which would otherwise irreparably damage a ceramic foam burner element, is rendered of no consequence. The use of the woven fiber ceramic burner element also allows a burner, heater or fluid apparatus incorporating the burner element to achieve the other advantages and objects described above.

BRIEF DESCRIPTION OF THE DRAWINGS

The nature and extent of the present invention will be clear from the following detailed description of the particular embodiments thereof, taken in conjunction with the appendant drawings, in which:

FIG. 2 is a cross-sectional view of the embodiment shown in FIG. 1;

FIG. 7 is a perspective view of a portion of another preferred embodiment of the present invention.

DETAILED DESCRIPTION OF THE INVENTION

Figure 1:
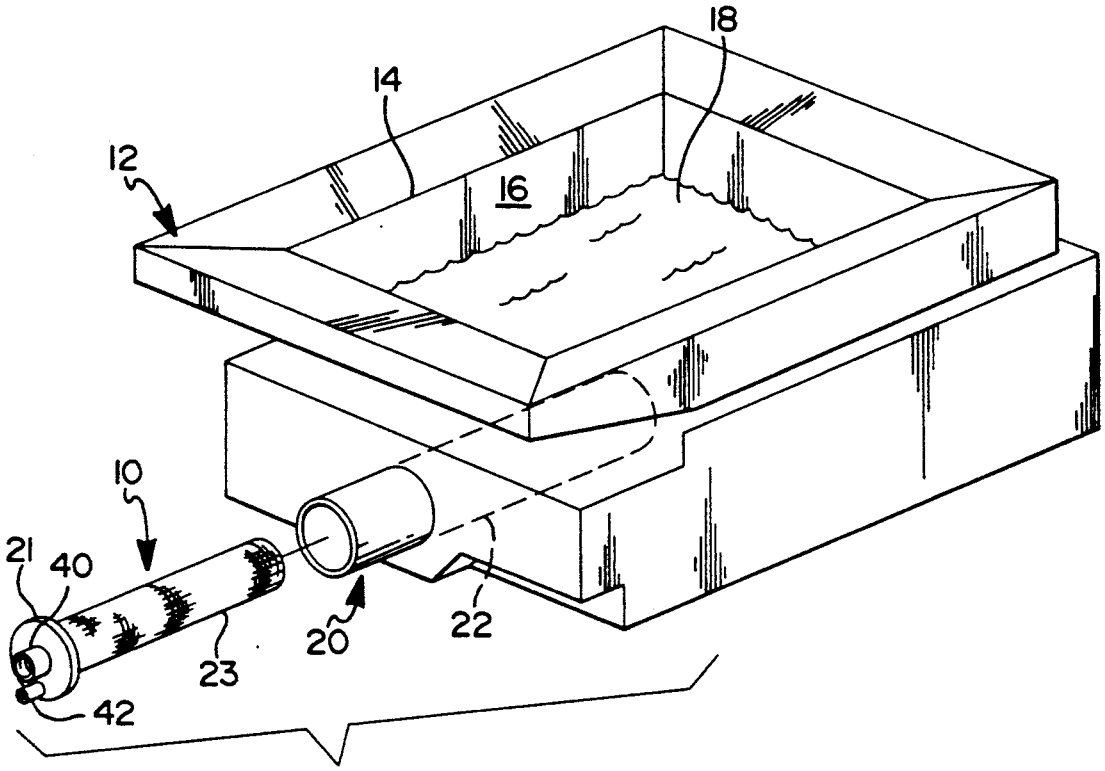
FIG. 1 is a perspective view of the preferred embodiment of the present invention.

With reference first to FIGS. 1 and 2, a burner 10 according to the present invention is shown in conjunction with a fluid immersion apparatus such as a deep fat fryer 12. The fryer includes a walled tank 14 defining a chamber 16 containing a fluid 18 therein, such as liquefied fat. The fryer 12 includes an infrared heater 20 which incorporates the burner 10 and which has an outer metal tube 22 positioned adjacent to and preferably forming part of one of the walls 24 of the tank 14. The burner 10 is positioned within the tube 22 so as to heat the tube 22, which in turn heats the fluid 18 contained in the tank 14.

Figure 3:
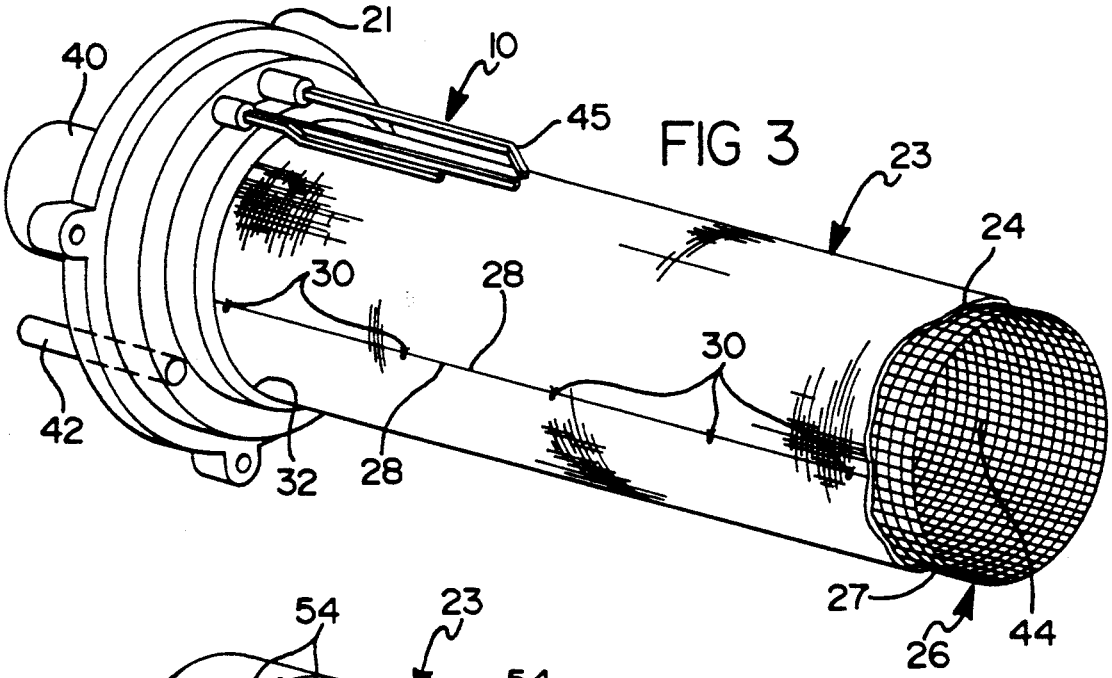
FIG. 3 is a partial, perspective view of a portion of the preferred embodiment of the present invention.

With reference now to FIG. 3, the burner 10 includes a burner element 23 formed as a piece of a woven ceramic fiber cloth 24 wrapped about a support 26 such as a wire mesh cylinder 27. The cloth piece 24 is rectangular in shape and has abutted edges 28 connected together at spaced locations by ceramic fiber threads 30, preferably of the same composition as the cloth piece 24. Alternatively, the threads 30 can be made of a different non-reactive, heat-resistant material, or a metal wire.

The burner 10 also comprises a base 21 to which the wire mesh cylinder 27 and the woven ceramic cloth piece 24 are affixed. The base 21 is preferably composed of reinforced ceramic. The woven ceramic fiber burner element 23 is sealed to the base 21 by a layer of a conventional liquid ceramic 32. The burner 10 further includes a cap 34 sealed to the cloth 24 by another layer 36 of a conventional liquid ceramic.

The metal tube 22 of the infrared heater 20 is disposed about and spaced from the burner element 23 so as to define a plenum 38 between the woven ceramic burner element 23 and the metal tubes 22. The burner 10 includes supply means such as ports 40 and 42 formed in the base 21 for supplying combustion gas and air, respectively, to the interior 44 of the burner element 23 and to the plenum 38. The ports are connectable to conventional gas and air supply lines (not shown), for example, to tanks of air and combustible gas. An ignitor element 45 is carried by the burner 10 and is located closely adjacent to one surface of the burner element 23, for example, its outer surface 46. Upon activation of the ignitor element 45, combustion of the supplied gas will occur on the outer surface 46 of the burner element 23. The gas and air supplies to the ports 40 and 42 can of course be reversed, and the ignitor element 45 positioned closely adjacent to an interior surface 48 of the burner element 23, to yield combustion on the interior surface 48.

The gas permeability of the ceramic fiber weave making up the burner element 23 is selected to prevent any appreciable or significant backflashing during combustion. The gas permeability of a woven cloth made of ceramic fibers is determined by the pore size and the thickness of the cloth. The pore size and cloth thickness will affect the backpressure in the combustion gas supply required for operation. The gas permeability must be selected to match this backpressure, as well as the composition and the combustion gas flow rate. For example, when a burner element in accordance with the present invention is used in a conventional deep fat fryer of a size useful for restaurant service, the gas permeability of the burner element is preferably between 25 and 500 cubic feet per square foot per minute measured at 0.5 inches of water column pressure (w.c.), depending upon the gas employed. Multiplying the gas permeability (in cubic feet per square foot per minute) by 32.05 yields an approximate value for the maximum useful heat output from the burner element 23 in btu-hours per square inch.

The useful range of gas permeabilities of the burner element 23 varies with the particular gas combusted because different gases have different flame velocities; different gases therefore require different mixture velocities in order to prevent backflashing (the unintended creeping of the flame back into the burner element 23). However, the gas mixture velocity at a given pressure depends upon and can thus be controlled by the gas permeability of the burner element 23. The gas permeability of a burner element 23 useful for combusting natural gas is a convenient reference for permeabilities useful with other gases. For example, it is desirable that when natural gas is to be combusted, the gas permeability of the burner element 23 is between 25 and 500 cubit feet per square foot per minute (0.5 inches water column), and preferably about 118 cubic feet per square foot per minute. Natural gas has a flame velocity of about 1 foot per second. Combustion gases containing molecular hydrogen, in contrast, have flame velocities on the order of 9 feet per second. Accordingly, a burner element 23 useful for combusting a hydrogen-containing gas mixture such as manufactured gas (a commercially available mixture containing about 50 percent molecular hydrogen plus some natural gas and carbon dioxide) preferably has a gas permeability of no more than 42 percent of the gas permeability of a comparable element used for combusting natural gas. Thus, when manufactured gas is used, it is desirable that the gas permeability of the burner element 23 is no more than 210 cubic feet per square foot per minute, and preferably about 50 cubic feet per square foot per minute. The desirable and preferred permeabilities for a burner element 23 for combusting propane are between those of natural gas and manufactured gas, since its flame velocity is between their flame velocities. These gas permeabilities can typically be achieved in a burner element constructed from a woven ceramic fiber cloth having a pore size of 0.01 to 0.06 inches and a thickness of 0.1 to 4.0 millimeters.

The mesh size of the support 26 should be selected so that it has at most an inconsequential effect on the gas permeability of the burner element 23, as long as it provides adequate support to the burner element 23. For example, the mesh size of the cylindrical screen 27 should preferably be at least a few times greater than the pore size of the cloth 24 wrapped about it. Above such a mesh size, the mesh size is not critical.

The ceramic fibers which are woven to form the burner element 23 of the present invention can be composed of metal oxide, alumina, quartz, vitreous silica, or other heat resistant ceramic that can withstand up to 2300° F. It is particularly preferred that the fibers are made of a specific alumina-boria-silica ceramic fiber, incorporated into a ceramic fabric and sold under the brand name "Nextel 312" by 3-M Company, St. Paul, Minn. "AMISIL" brand (Auburn Manufacturing Corporation), "Fiberfrax Woven Textile" brand and "Flexweave" brand (both from Carborundum Corporation) fabrics are also preferred woven cloths for constructing the burner element 23.

Four preferred varieties of Nextel brand ceramic fabrics are woven as double layer weave, five harness satin weave, crow foot satin weave and plain weave, all of which are useful in the present invention. The thread counts for these varieties range from 19 to 40 per inch warp, and 17 to 20 per inch fill, yielding air permeabilities of from 36 to 240 cubic feet per square foot per minute, depending upon the denier of the ceramic yarn employed in making the fabrics.

The tensile strength of the ceramic fibers used to make the woven burner element 23 are not believed to be critical to the utility of the fibers in the present invention, so long as the brittleness encountered with ceramic foams or the like is avoided. The fibers of the preferred Nextel 312 brand ceramic cloths have a tensile strength of 250,000 psi. The preferred Nextel fabrics also have a continuous use temperature of 2200° F. and a short term use temperature of 2600° F., with a melt temperature of about 3272° F.

Figure 6:
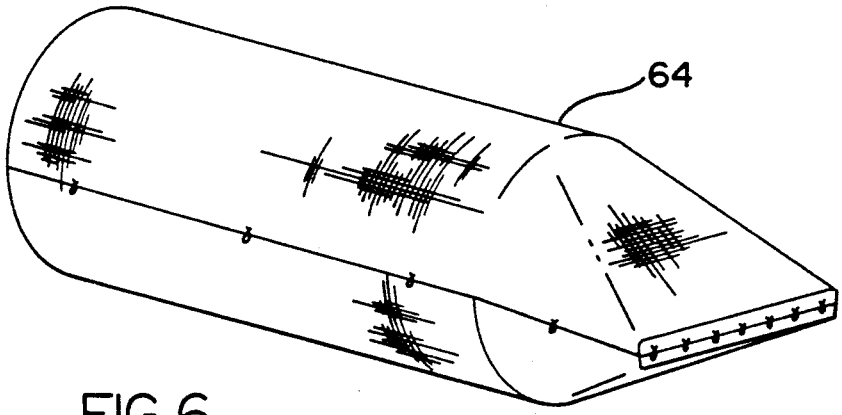
FIG. 6 is a perspective view of a portion of another preferred embodiment of the present invention.
Figure 4:
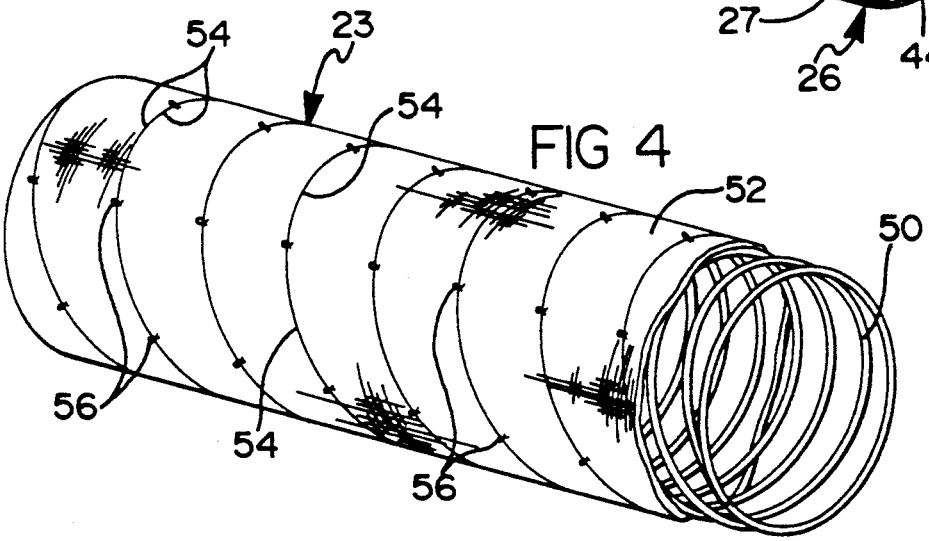
FIG. 4 is a partial, perspective view of another preferred embodiment of the present invention, similar to FIG. 3.

The physical configuration of the burner element 23 can be chosen as may be advantageous for the particular environment of use contemplated. When disposed about a support 26, the burner element 23 will preferably conform to the shape of that support 26. Although the support 26 has been disclosed in the first preferred embodiment of the invention as a wire mesh cylinder 27, as shown in FIG. 4, the support 26 can alternatively comprise a wire coil spring 50 instead of the cylinder 27. Moreover, with either the cylinder 27 on the spring 50, the burner element 23 can alternatively be configured as a woven ceramic fiber cloth tape 52 wrapped at a diagonal pitch on the support 26, such as the spring 50. Adjacent edges 54 of the cloth tape 52 abut one another and are joined at spaced locations by threads 56, again, of the same or a different ceramic fiber as the cloth tape 52, or of wire or other heat resistant material. Of course, the shape of the support 26 allows other shapes to be employed for the burner element 23, for example, closed, pinched-end tubular 64 (FIG. 6) or relatively flattened 66 (FIG. 7) shapes.

Figure 5:
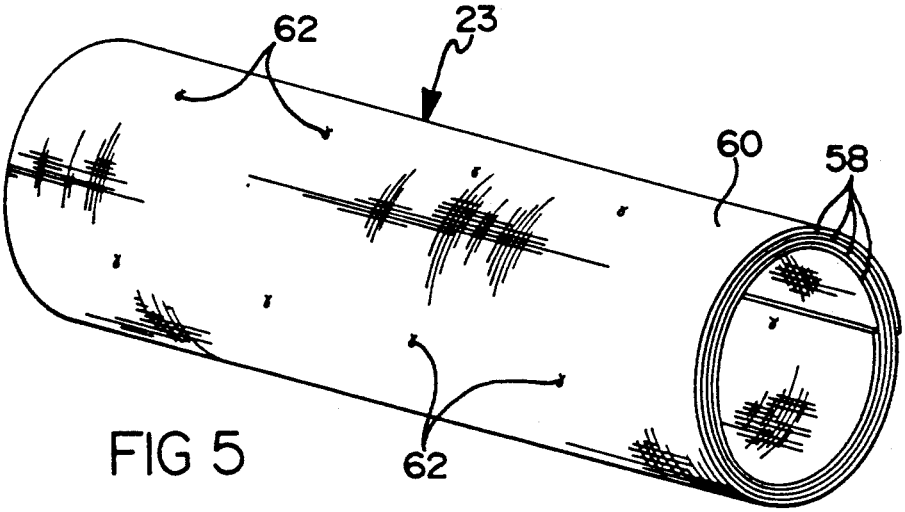
FIG. 5 is a perspective view of a portion of another preferred embodiment of the present invention.

The support 26 can be rigid, as when the coil spring 50 is stiff, or the support 26 can be semi-rigid, as when the mesh cylinder 27 is used. Indeed, the burner 10 need not include any support 26 at al. For example, in another preferred embodiment of the present invention as disclosed in FIG. 5, the burner element 23 can be configured as a plurality of layers 58 of a woven ceramic fiber cloth, such as provided by the spiral wrapping of a single piece 60 of woven ceramic fiber cloth upon itself. The layers 58 are fixed with respect to one another at spaced locations by threads 62 like those described earlier. Movement of the layers 58 with respect to one another thus being prevented, the burner element 23 so formed possesses adequate ridigity for use. Its open ends are preferably closed by the ceramic base 21 and the end cap 34 disclosed above, and sealed to them in the fashion described before.

The present invention thus provides a woven ceramic burner element, an infrared heater including the burner element, and a fluid immersion apparatus incorporating the heater, which address and meet the objects mentioned above, and which achieve superior efficiency, uniformity, reliability and durability in combusting fuel gas for heating.

While the invention has been described in terms of several specific embodiments, it must be appreciated that other embodiments could readily be adapted by one skilled in the art. Accordingly, the scope of the invention is to be limited only by the following claims.

What is claimed is:

1. A radiant gas burner for burning a flowing combustible gas, comprising a hollow burner element made from woven ceramic fibers and possessing a predetermined gas permeability matching the flame velocity of said combustible gas, wherein said burner element is configured as a cylinder having an open end, and wherein said open end is closed by a ceramic cap sealed to said cylinder by a liquid ceramic.

2. The burner of claim 1, wherein said gas permeability of said element matches the flow rate, composition and backpressure of said combustible gas.

3. The burner of claim 1, wherein said burner element further comprises a support about which said woven ceramic fibers are disposed.

4. The burner of claim 1, wherein said ceramic fibers are formed as a cloth.

5. The burner of claim 4, wherein said cloth is characterized by a pore size of 0.01 to 0.06 inches.

6. The burner of claim 1, wherein said woven ceramic fibers are configured in a cylindrical shape.

7. The burner of claim 1, wherein said woven fibers are configured in a tubular shape.

8. The burner of claim 1, wherein said woven ceramic fibers are configured in a relatively flattened shape.

9. The burner of claim 1, wherein said fibers are formed as a cloth wrapped about said support.

10. The burner of claim 1, wherein said support comprises a wire mesh.

11. The burner of claim 1, wherein said support is rigid.

12. The burner of claim 1, wherein said support is semi-rigid.

13. The burner of claim 1, wherein said gas permeability of said element is about 25 to 500 cubic feet per square foot per minute.

14. The burner of claim 1, wherein when said gas is natural gas, said gas permeability of said burner element is 25 to 500 cubic feet per square foot per minute.

15. The burner of claim 1, wherein when said gas is manufactured gas, said gas permeability of said burner element is less than or equal to 210 cubic feet per square foot per minute.

16. The burner of claim 1, wherein said fibers are alumina-boria-silica, metal oxide, alumina, quartz, or vitreous silica.

17. The burner of claim 1, further comprising an ignition element positioned adjacent a surface of said burner element.

18. The burner of claim 17, further comprising means adapted to supply said combustible gas and air to said burner element.

19. A radiant gas burner for burning a flowing combustible gas, comprising a hollow burner element made from a cloth of woven ceramic fibers, possessing a predetermined gas permeability matching the flame velocity of said combustible gas and formed as a plurality of layers of said cloth, structured so as to be self-supporting.

20. The burner of claim 19, wherein said layers are joined by ceramic fiber threads so as to prevent movement of said layers relative to one another.

21. The burner of claim 19, wherein said layers are formed as a spiral wrap of a single piece of cloth.

22. The burner of claim 19, wherein said cloth is about 0.1 to 4.0 millimeters thick.

23. The burner of claim 19, wherein said cloth is characterized by a pore size of 0.01 to 006 inches.

24. A radiant gas burner for burning a flowing combustible gas, comprising a hollow burner element made from woven ceramic fibers and possessing a predetermined gas permeability matching the flame velocity of said combustible gas, and a support about which said woven ceramic fibers are disposed, wherein said support consists of a coil spring.

25. The burner of claim 24, wherein said fibers are formed as a cloth wrapped about said support, diagonally pitched with respect to the axis of said spring.

26. The burner of claim 25, wherein said cloth is characterized by a pore size of 0.01 to 0.06 inches.

27. The burner of claim 25, wherein said cloth is about 0.1 to 4.0 millimeters thick.

28. The burner of claim 24, wherein said woven ceramic fibers are configured in a cylindrical shape.

29. The burner of claim 24, wherein said woven ceramic fibers are configured in a relatively flattened shape.

30. The burner of claim 24, wherein said support is rigid.

31. The burner of claim 24, wherein said gas permeability of said element is about 25 to 500 cubic feet per square foot per minute.

32. The burner of claim 1, wherein said gas permeability of said element is abut 25 to 500 cubic feet per square foot per minute.

33. The burner of claim 19, wherein said cloth is about 0.1 to 4.0 millimeters thick.

* * * * *